US005996666A

United States Patent [19]

Denina

[11] Patent Number: 5,996,666

[45] Date of Patent: Dec. 7, 1999

[54] EXTENDABLE SUNSHADE FOR DRIVEWAYS

[76] Inventor: Eugene B. Denina, 2742 E. Monroe St., Long Beach, Calif. 90810

[21] Appl. No.: 09/089,076

[22] Filed: Jun. 2, 1998

[51] Int. Cl.[6] ..... E04F 10/10; E05D 15/06

[52] U.S. Cl. ..... 160/62; 160/202; 160/211; 49/197; 52/222

[58] Field of Search ..... 49/70, 124, 125, 49/126, 127, 128, 197, 198, 203, 323; 160/113, 118, 119, 201, 62, 211, 202; 135/121, 122, 129; 52/222, 7; 248/918, 118, 118.1; 108/44, 73, 74, 143, 48, 47, 97, 98, 91, 93

[56] References Cited

U.S. PATENT DOCUMENTS

| | | | |
|---|---|---|---|
| 370,259 | 9/1887 | Horbaczewski | 160/202 |
| 2,160,958 | 6/1939 | Critchlow | 108/44 |
| 2,280,368 | 4/1942 | Bassett | 160/202 |
| 2,699,823 | 1/1955 | Zveibil | 160/62 |
| 2,909,220 | 10/1959 | Zimmerman | 160/62 |
| 3,331,425 | 7/1967 | Groves et al. | 160/113 |
| 3,430,676 | 3/1969 | Aberg | 160/202 |
| 3,709,159 | 1/1973 | Oglesby, Jr. | 108/44 |
| 3,896,742 | 7/1975 | Ferraro | 108/44 |
| 3,899,982 | 8/1975 | Fetzek | 108/143 |
| 4,231,412 | 11/1980 | Nowak | 160/113 |
| 4,325,561 | 4/1982 | Lynn | 108/91 |
| 4,494,465 | 1/1985 | Fick, Jr. | 108/44 |
| 4,938,441 | 7/1990 | Hannah et al. | 108/143 |
| 4,993,088 | 2/1991 | Chudik | 108/44 |
| 4,995,322 | 2/1991 | Fredrick | 108/44 |
| 5,090,335 | 2/1992 | Russell | 108/44 |
| 5,140,914 | 8/1992 | Bohbot et al. | 108/44 |
| 5,156,195 | 10/1992 | Wehler et al. | 160/202 |
| 5,408,789 | 4/1995 | Plfeger | 160/113 |
| 5,533,771 | 7/1996 | Taylor et al. | 108/44 |
| 5,540,158 | 7/1996 | Ford | 108/44 |
| 5,611,382 | 3/1997 | Sferra | 160/201 |

*Primary Examiner*—Jerry Redman
*Assistant Examiner*—Curtis A. Cohen
*Attorney, Agent, or Firm*—Goldstein & Canino

[57] ABSTRACT

An extendable sunshade for attachment to a garage door comprising a plurality of canopy units and a support frame mounted to the inside face of the garage door for supporting the canopy units. A pair of support rails are disposed on the support frame for slidably engaging with a first canopy unit. Each of the canopy units includes a rectangular body structure having large openings, about which coverings are securely attached and telescopic legs pivotally connected to the corners of the body structure for maintaining the canopy unit in the extended position. Each of the canopy units further includes two external sides on which a plurality of rollers are disposed about for slidably engaging with support rails and two internal sides provided with support rails for slidably engaging with the rollers of an inner canopy unit. The canopy units can be slidably extended from the support frame while the garage door is opened to provide shade over the driveway.

5 Claims, 3 Drawing Sheets

EXTENDABLE SUNSHADE FOR DRIVEWAYS

BACKGROUND OF THE INVENTION

This invention relates to an extendable sunshade for driveways. More particularly, the invention relates to an extendable sunshade which is adapted to be mounted to the inside face of a garage door and can be extended, while the garage door is opened, to provide shade over the driveway.

Repairing and servicing an automobile in the driveway may require a person to spend a long period of time exposed to direct sunlight. In hot and sunny weather, over-exposure to the sunshine can cause major discomfort and eventually discourage one from performing these necessary tasks. Moreover, the driveway pavement tends to collect heat when exposed to direct hot summer sunshine for a long period and may cause the overall temperature of the driveway to rise to an unpleasant and unbearable level. Thus, it is desirable to have a sunshade that is adapted to provide a shaded covering over the driveway so as to allow people to conveniently work on their vehicles and the like in the cool shade, sheltered from the unpleasant hot summer sun.

Various references uncovered in the prior art provide an extendible and retractable shelter for protecting motor vehicles against the weather. For example, U.S. Pat. No. 4,150,682 to Ryce discloses an extendible and retractable portable shelter that is adapted to be opened and extended over an automobile. U.S. Pat. No. 4,844,109 to Navaro discloses another extendible and retractable shelter for automobiles. Likewise, U.S. Pat. No. 5,331,777 to Chi-Yuan discloses a frame assembly for a collapsible folding vehicle barn. However, most of these prior art motor vehicle shelters are designed to protect an automobile from the elements without requiring additional parking area and consequently, do not provide a sufficient amount of space required for repairing and servicing an automobile.

While these units mentioned above may be suitable for the particular purpose employed, or for general use, they would not be as suitable for the purposes of the present invention as disclosed hereafter.

SUMMARY OF THE INVENTION

It is an object of the invention to provide a sunshade which provides a shaded covering over a driveway so as to allow people to conveniently work on their vehicles and the like in the cool shade, sheltered from the unpleasant hot summer sun.

It is another object of the invention to provide a sunshade which is adapted to be mounted to the inside face of a garage door and can be extended while the garage door is opened, to provide shade over the driveway.

It is yet another object of the invention to provide an extendable sunshade which can be fully retracted into the support frame attached to a garage door for convenient storage, when it is not being used.

The invention is an extendable sunshade for attachment to a garage door comprising a plurality of canopy units and a support frame mounted to the inside face of the garage door for supporting the canopy units. A pair of support rails are disposed on the support frame for slidably engaging with a first canopy unit. Each of the canopy units includes a rectangular body structure having large openings, about which coverings are securely attached and telescopic legs pivotally connected to the corners of the body structure for maintaining the canopy unit in the extended position. Each of the canopy units further includes two external sides on which a plurality of rollers are disposed about for slidably engaging with support rails and two internal sides provided with support rails for slidably engaging with the rollers of an inner canopy unit. The canopy units can be slidably extended from the support frame while the garage door is opened to provide shade over the driveway.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
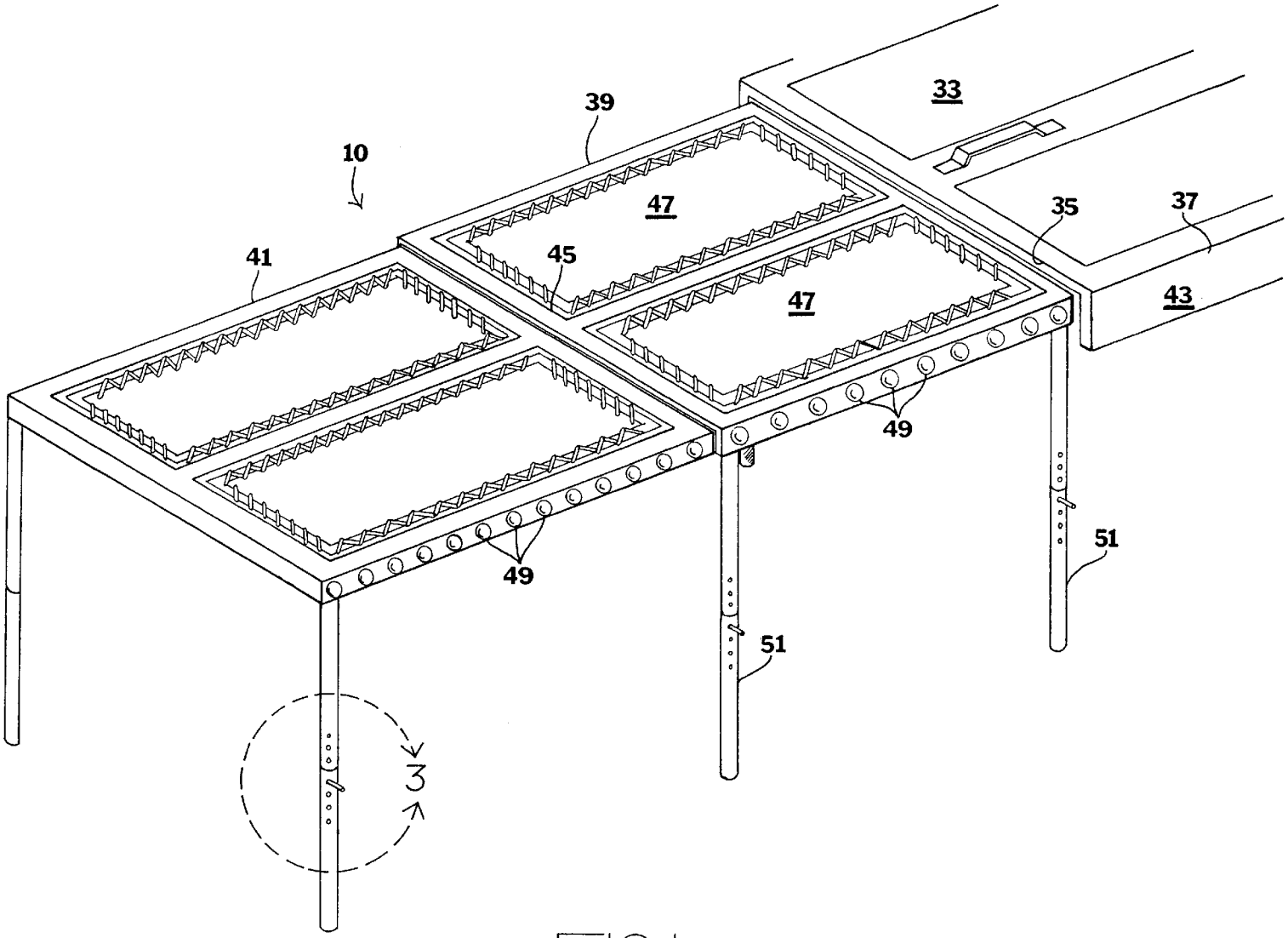
FIG. 1 is a diagrammatic perspective view of an extendable sunshade in accordance with the principles of the present invention.

FIG. 1 illustrates a preferred embodiment of an extendable sunshade 10 in accordance with the principles of the present invention. For better understanding of the present invention, a garage door 33 in an open position is illustrated which is defined in part by an inside face, a lower end 35, and side edges 37. As will be seen in following paragraphs, the present invention is designed to be mounted to the inside face of the garage door 33 and can be extended, while the garage door is opened, to provide shade over the driveway.

The sunshade 10 of the present invention comprises first 39 and second 41 canopy units and a support frame (which is not shown) mounted to the inside face of the garage door 33 for supporting the canopy units 39 and 41. The support frame is defined in part by a back cover plate, side panels 43, and a front cover plate. The side panels 43 are secured to the inside face of the garage door adjacent the side edges 37 thereof. A pair of support rails are disposed on the side panels 43 of the support frame for slidably receiving the first canopy unit 39. The front cover plate is swingably mounted to the side panels 43 adjacent to the lower end 35 of the garage door 33 and can be swung opened to provide access to the canopy units 39 and 41 inside the support frame and can be closed when the sunshade 10 is not in use.

As seen by referring to FIG. 1, each of the canopy units 39 and 41 of the present invention includes a rectangular body structure 45 having large openings, about which coverings 47 are securely attached by means of heavy duty nylon ropes sewn through the eyeholes provided therein. The coverings 47 can be constructed of a canvas or any other suitable water resistant materials, including tarpaulin. The canopy units 39 and 41 may be manufactured in various sizes to conform to different garage door sizes, including standard one and two car garage doors.

The sliding movement of the canopy units 39 and 41 in and out of the garage door 33 may be carried out in a number of ways. In the preferred embodiment, the first canopy unit 39 has two external sides on which a plurality of rollers 49 are disposed about for slidably engaging with support rails, and two internal sides provided with support rails for slidably receiving the rollers 49 of the second canopy unit 41. The sunshade 10 of the present invention can have any number of canopy units, and in the embodiment as shown in FIG. 1, two canopy units are utilized—the first canopy unit 39 slidable in and out of the support frame and the second canopy unit 41 slidable in and out of the support rails of the first canopy unit. Although FIG. 1 illustrates the canopy units having rollers, it should be noted that the slide mechanism can be of any other suitable configuration capable of sliding one inside another, including ball bearings, sliders, and the like.

Figure 2:
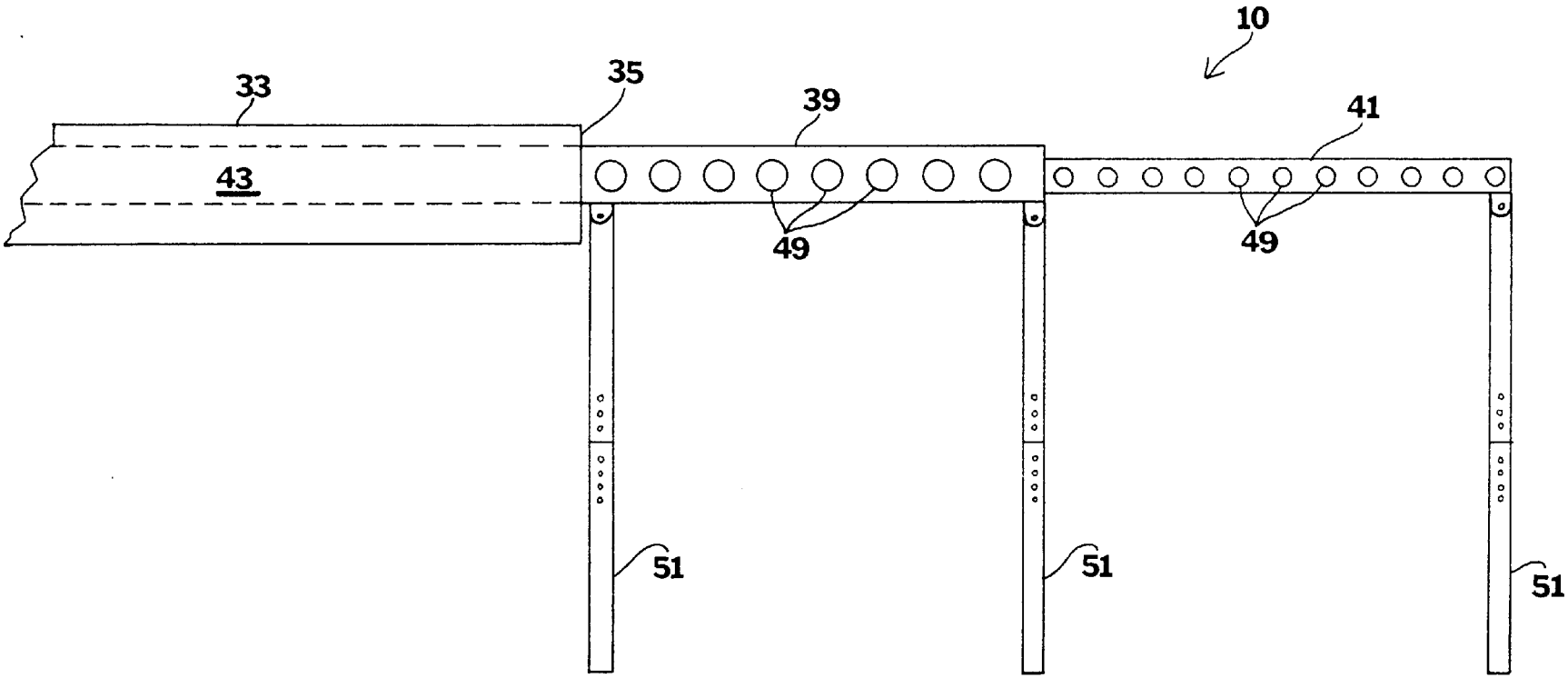
FIG. 2 is a side elevational view of a preferred embodiment of the extendable sunshade of the present invention in an extended position.
Figure 3:
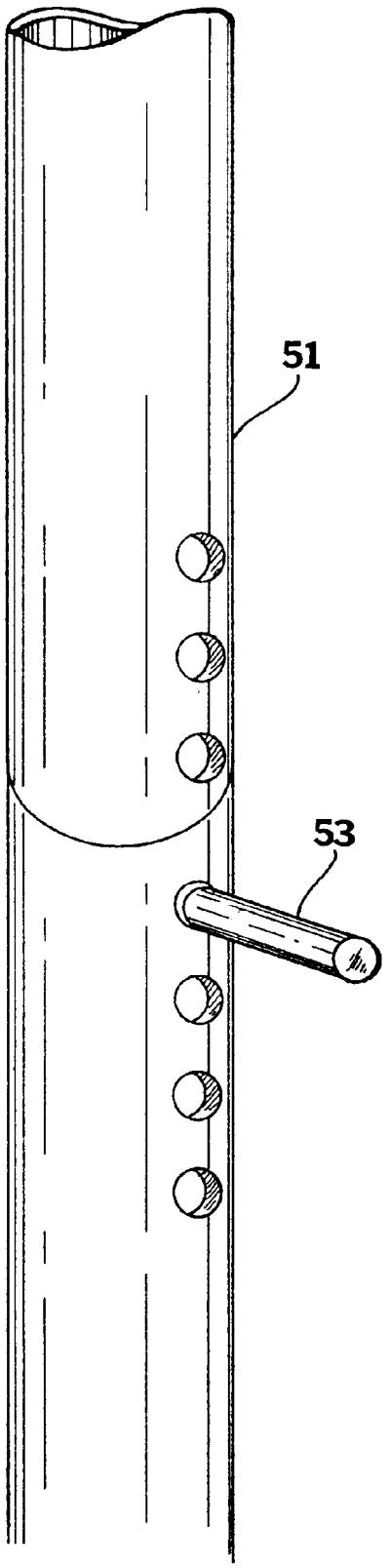
FIG. 3 is an enlarged perspective view of the area indicated in circle 3 in FIG. 1.

The canopy units are provided with telescopic legs 51 for supporting and maintaining the canopy units in the extended position. FIG. 2 illustrates the legs 51 pivotally connected to the corners of the canopy units 39 and 41 so that the legs 51 can be folded within the canopy units before the canopy units are pushed inside the slide frame. Each of the telescopic legs 51 includes at least two telescopic parts, one sliding inside the other, and adjustment means for selectively adjusting the length of the leg and limiting the telescopic movement of the inner telescopic part when a desired length has been selected. As seen by referring to FIG. 3, the preferred embodiment of the present invention contemplates providing a pin adjustment means 53 to selectively shorten or lengthen the telescopic legs 51 to conform to the slope of the driveway.

The operation of the extendable sunshade 10 will now be described. When a shaded covering over the driveway is desired, the front cover plate of the support frame is first opened, while the garage door 33 is opened, to enable access to the canopy units 39 and 41 retained therein. Whereupon, the first canopy unit 39 is then pulled out of the support frame and the telescopic legs are pulled down to support the first canopy unit 39 in the extended position, before extending the second canopy unit 41. The canopy units 39 and 41 of the present invention can remain extended from the garage door 33 until closing of the garage door is necessary.

While the preferred embodiment of the present invention is disclosed in relation to an extendable sunshade adapted to be mounted to a garaged door, it should be noted that the sunshade disclosed herein can easily be modified to provide shade over a driveway without being mounted to a garage door. Many specific details contained in the above description merely illustrate some preferred embodiments and should not be construed as a limitation on the scope of the invention. Many other variations are possible.

What is claimed is:

1. An extendable sunshade attached to a garage door, said garage door having an inside face, comprising:

a) supporting means attached to said inside face of said garage door;

b) at least one canopy unit slidably supported within said supporting means, said canopy unit moveable between a retracted position wherein said canopy unit is fully retained within said supporting means and an extended position wherein said canopy unit is extended from said supporting means to provide shade over an area adjacent to said garage door; and c) a plurality of legs extending downwardly from said canopy unit for maintaining the canopy unit in said extended position, said legs pivotally connected to said canopy unit so that the legs can be rotated to fit within the canopy unit before the canopy unit is pushed into the supporting means.

2. The extendable sunshade as recited in claim 1, wherein the supporting means comprises a pair of main support rails secured to the inside face of the garage door, and wherein the canopy unit has two external sides provided with a plurality of rollers for rollably engaging with said main support rails.

3. The extendable sunshade as recited in claim 1, wherein the canopy unit further comprises a rectangular body structure having an opening and a water resistant covering securely attached to said body structure to cover said opening.

4. The extendable sunshade as recited in claim 1, wherein the legs have telescopic means incorporated therein for permitting selective adjustment of the length thereof.

5. The extendable sunshade as recited in claim 2, wherein the canopy unit further comprises first and second canopy units, said first canopy unit having two external sides provided with a plurality of rollers for rollably engaging with the main support rails and two internal sides provided with first support rails for slidably receiving said second canopy unit, said second canopy unit having two external sides provided with a plurality of roller for rollably engaging with said first support rails.

* * * * *